US005146728A

United States Patent [19]

Knecht et al.

[11] Patent Number: 5,146,728

[45] Date of Patent: Sep. 15, 1992

[54] APPARATUS FOR THE PACKAGING OF CIGARETTES

[75] Inventors: Siegfried Knecht, Gevelsberg; Jürgen Sakowski, Ennepetal, both of Fed. Rep. of Germany

[73] Assignee: Maschinenfabrik Alfred Schmermund GmbH & Co., Gevelsberg, Fed. Rep. of Germany

[21] Appl. No.: 623,608

[22] Filed: Dec. 7, 1990

[30] Foreign Application Priority Data

Dec. 9, 1989 [DE] Fed. Rep. of Germany ..... 3940789

[51] Int. Cl.[5] ..... B65B 11/38; B65B 61/20; B65B 19/02

[52] U.S. Cl. ..... 53/136.1; 53/234; 53/580

[58] Field of Search ..... 53/148, 136.1, 234, 53/580, 207

[56] References Cited

U.S. PATENT DOCUMENTS

| | | | |
|---|---|---|---|
| 3,802,325 | 4/1974 | Bardenhagen | 53/148 |
| 4,084,393 | 4/1978 | Focke | 53/207 X |
| 4,179,864 | 12/1979 | Focke | 53/234 |
| 4,612,756 | 9/1986 | Focke et al. | 53/234 |
| 4,711,065 | 12/1987 | Focke et al. | 53/234 X |

*Primary Examiner*—John Sipos
*Attorney, Agent, or Firm*—Chilton, Alix & Van Kirk

[57] ABSTRACT

In apparatus for the packaging of cigarettes, a collar defining member is positioned relative to a block of cigarettes, which has previously been wrapped in an inner paper, during the transfer of the wrapped block from a carrier cell of a first conveyor into a receiving cell of a second conveyor. The collar defining members are automatically fed into a transfer station, defined by a space between the conveyors where a carrier cell and a receiving cell are in an aligned confronting relationship, and the collar defining member is folded about the wrapped block of cigarettes as it is pushed from a carrying cell into a receiver cell.

18 Claims, 2 Drawing Sheets

APPARATUS FOR THE PACKAGING OF CIGARETTES

BACKGROUND OF THE INVENTION

1. Field of the Invention

This invention relates to the packaging of cigarettes and particularly to the formation of hinged-lid type cigarette packages. More specifically, the present invention is directed to apparatus for use in the packaging of cigarettes, and especially to apparatus for the insertion of collar-defining members into partly formed packages of cigarettes as such partly formed packages are transferred between cells of a pair of conveyors which form part of the packaging line. Accordingly, the general objects of the present invention are to provide novel and improved methods and apparatus of such character.

2. Description of the Prior Art

The present invention is intended for use in the packaging of cigarettes and particularly in the formation of hinged-lid type packages. Such hinged-lid packages are well known in the art and are formed by folding an outer package blank around a block of cigarettes which has been wrapped in an inner paper. Such packages are provided with a shaped member, known in the art as a "shoulder strip", which is adhesively bonded to the blank from which the outer package or wrapper is formed. In the finished package, the shoulder strip is arranged on the inside of the outer wrapper to define a collar which delimits a removal zone at the front and two adjacent sides of the package. The collar defining member must be folded during the package formation process and, accordingly, is provided with fold lines. Additionally, the collar defining member is provided with incisions which, when the collar is in the folded state, result in projections which extend from the front side of the package and assist in the retention of the hinged lid in the closed position. It is essential that the shoulder strips, i.e., the collar defining members, be correctly centered and positioned relative to the inner package, the inner package comprising a block of cigarettes which has previously been wrapped in an inner paper, so that the package may be completed and, when completed, will properly function. Furthermore, the positioning of the collar defining members relative to the inner package should be accomplished rapidly and automatically.

For a discussion of the formation of collar defining members for inclusion in cigarette packages, reference may be had to co-pending application Ser. No. 585,709.

SUMMARY OF THE INVENTION

The present invention achieves the above briefly stated objectives by providing a novel and improved device which, in an uncomplicated and efficient manner, ensures the correct positioning of collar defining members relative to wrapped cigarette blocks and subsequently folds the collar defining member about the wrapped cigarette blocks. The present invention also encompasses the novel process implemented by the aforesaid apparatus.

Apparatus in accordance with the invention cooperates with a pair of conveyors which support cells in which the partially packaged cigarette blocks are transported. These cells have a bottom wall and longitudinal side walls and are open on the end face and top. The conveyors are positioned such that a transfer station is defined in a region where cells on the two conveyors are in adjacent, spaced relationship with the open tops in facing relationship. A collar feed subassembly will deliver the collar defining members into the space between the facing cells located at the transfer station. In a preferred embodiment, the cigarette blocks wrapped in an inner paper arrive at the transfer station in cells on an upper conveyor and the feed subassembly positions a collar defining member above an empty receiving cell on the lower conveyor. Thereafter, during the transfer of the wrapped block from its carrier cell on the upper conveyor to the receiving cell on the lower conveyor, the collar defining member is pressed into the receiving cell by the wrapped cigarette block and, consequently, the collar defining member is folded about the wrapped block.

BRIEF DESCRIPTION OF THE DRAWINGS

The present invention may be better understood and its numerous objects and advantages will become apparent to those skilled in the art by reference to the accompanying drawings wherein like reference numerals refer to like elements in the two figures and in which.

DESCRIPTION OF THE DISCLOSED EMBODIMENT

Figure 1:
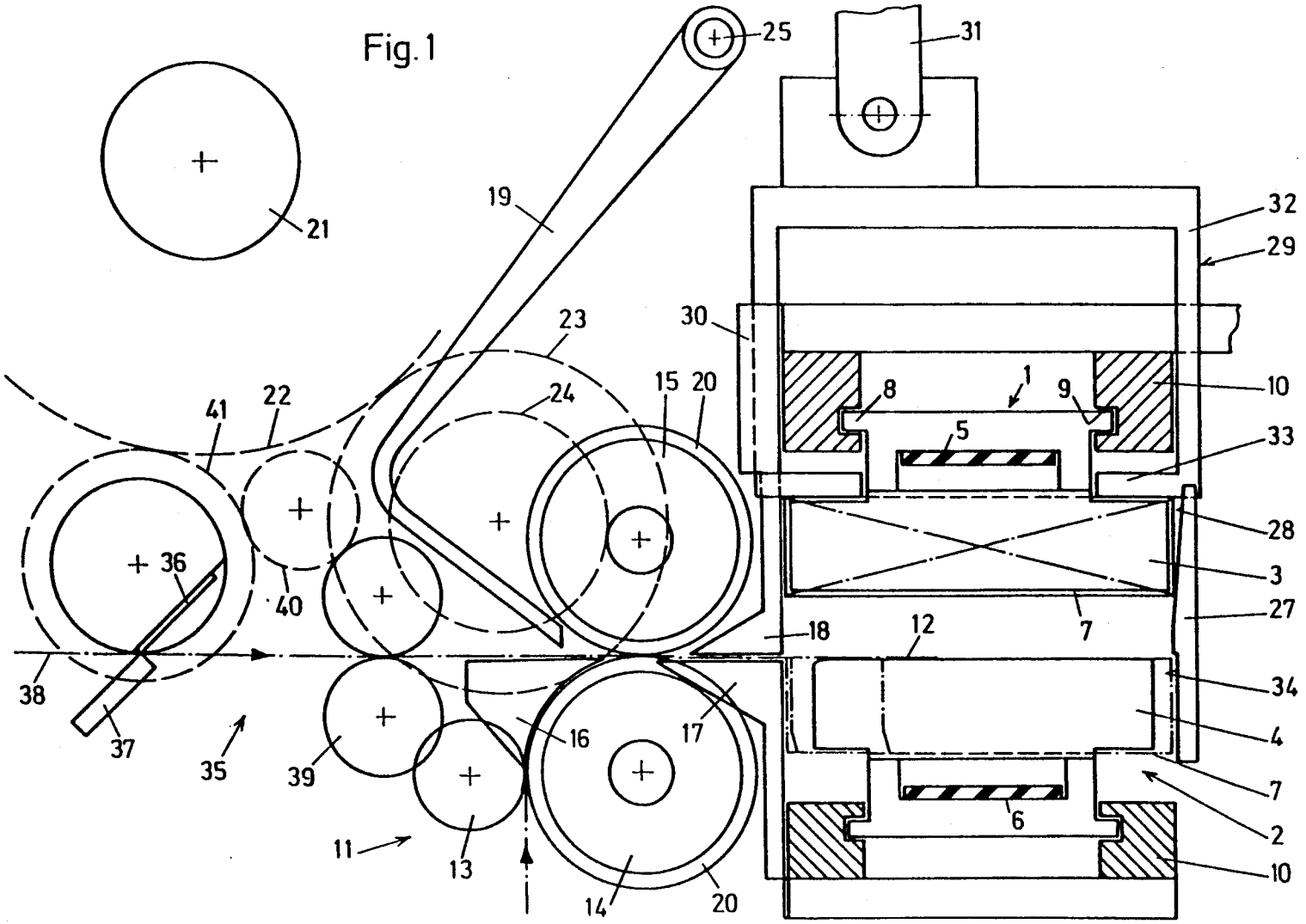
FIG. 1 is a schematic side elevation view, partly in section of apparatus in accordance with a first embodiment of the invention.

With reference now to the drawings, apparatus for use in the packaging of cigarettes in accordance with the invention includes a pair of conveyors which are indicated generally at 1 and 2. In the disclosed embodiment the conveyors 1 and 2 include endless belts, respectively indicated at 5 and 6, which are driven in a stepwise fashion and in synchronism. A plurality of package receiving cells 3 and 4 are supported on respective of the belts 5 and 6. It should be understood that the belt-type conveyors which have been illustrated could be replaced by other types of conveyor mechanisms such as, for example, rotary turrets equipped with cells. As the apparatus is depicted in FIG. 1, only the lower strand or run of the belt 5 of upper conveyor 1 and the upper strand or run of belt 6 of lower conveyor 2 have been shown. The belts 5 and 6, in the transfer region where they are shown, are arranged so as to be parallel and positioned such that the downwardly open cells 3 carried by conveyor 1 may be brought into registration with, but spatially displaced from, the upwardly facing open cells 4 carried by conveyor 2.

Blocks of cigarettes which have previously been wrapped in an inner paper arrive at the apparatus depicted in the drawing in the cells 3 of upper conveyor 1, such a wrapped cigarette block being represented at 7. The wrapping of the inner paper around the cigarette block will occur, in the packaging procedure, upstream of the apparatus depicted and the wrapping of the inner paper may take place on conveyor 1. During the transport of the wrapped cigarette blocks 7 along the lower run or strand of conveyor 1, a guide will prevent the contents of the cells 3 from falling from the cells under the influence of gravity. This guide has not been shown in the drawings.

The cells 3 and 4, respectively fastened to the belts 5 and 6, are provided with shoulders 8 which are received in guide grooves 9 of guide rails 10. The cells 3 and 4 are each open on their outwardly disposed sides, i.e., the sides positioned away from the supporting belts, and are also open on at least one end face. The cells 3 and 4 define cuboid-shaped receiving spaces which correspond to the size of a cigarette package.

The collar feed mechanism in accordance with the disclosed embodiment of the invention is indicated generally at 11. Feed 11 delivers individual collar defining blanks or members 12 from a supply, not shown, into the transfer zone between the cells 3 and 4. These collar defining members 12 are first received in the nip between a free running roller 13 and a driven conveying roller 14. The roller 14 interacts with a further driven conveying roller 15. A guide member 16, which defines an arcuate path, is positioned adjacent to the outer circumference of roller 14 and ensures that a collar defining member exiting the nip of rollers 13 and 14 will be delivered into the nip of rollers 14 and 15. A collar defining member 12, after being engaged by rollers 13, 14, is thus conveyed into the nip of rollers 14 and 15 and thence into a horizontal guide slot defined by guide members 17 and 18.

Figure 2:
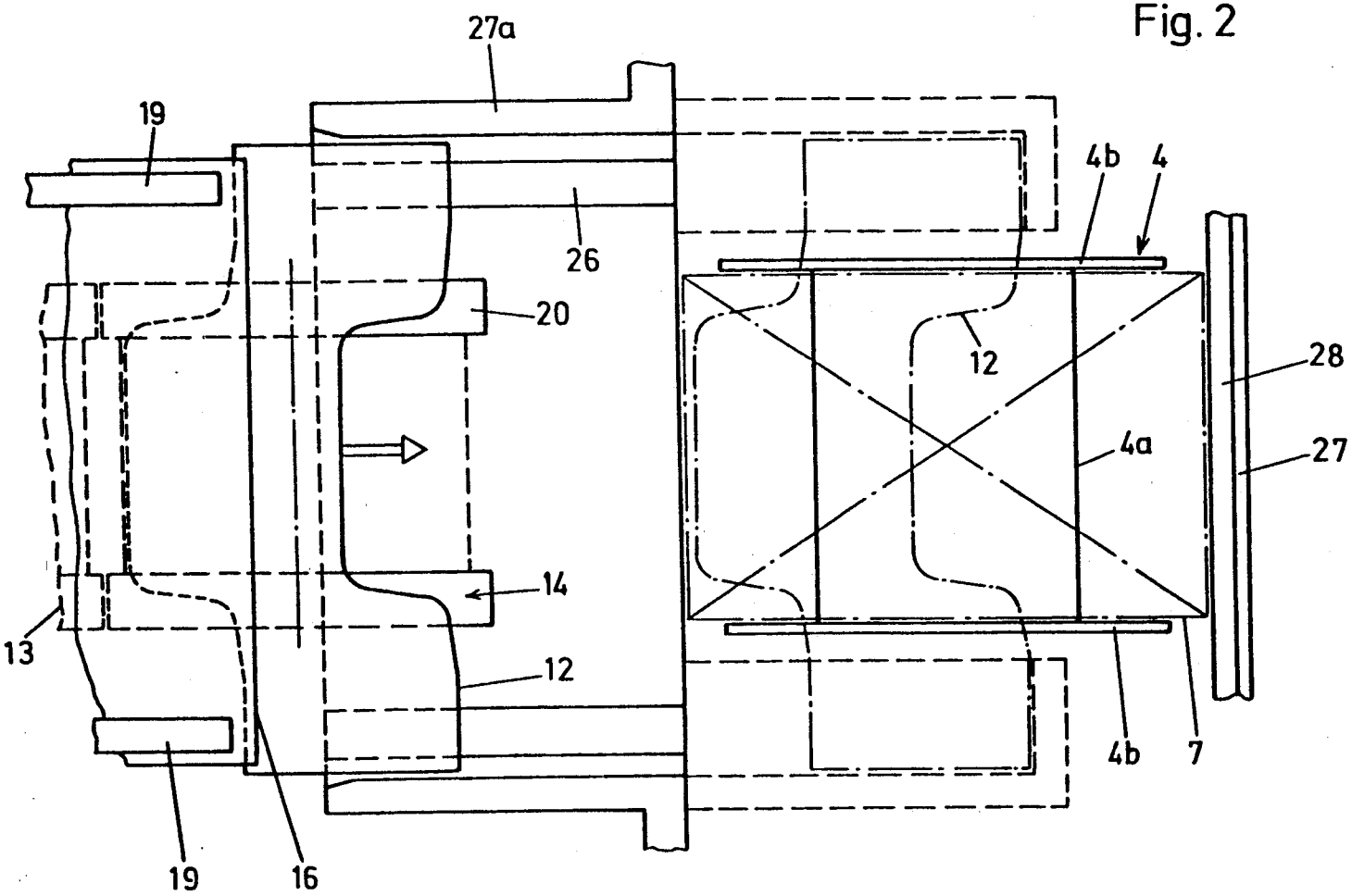
FIG. 2 is a top view which schematically depicts a portion of the apparatus of FIG. 1.

As may be seen from FIG. 2, the rollers 13, 14 and 15 engage the collar defining members 12 in a pair of transitional regions between the two leading outer tab-shaped ends and the trailing middle region. Thus, the rollers 13, 14 and 15 each comprise a pair of spaced coaxial roller disks 20. This arrangement results in the collar defining members 12 being conveyed over substantially their entire lengths.

The feed 11 also includes an advancer 19 which is in the form of a pivotal fork-shaped lever. A first end of a first arm of this lever is mounted on a drive shaft 25 while the second lever arm extends from the first arm at an angle of approximately 90°. The free end of the second arm of advancer 19 engages the collar defining members 12 as they leave the nip of rollers 14, 15. Advancer 19 transports the collar defining members 12 through the guide slot defined by the guide members 17 and 18 and pushes the collar defining members 12 into a location where they will ultimately be in registration with a cell 4 of the conveyor 2.

The feed 11 is driven by a drive shaft 21. Drive shaft 21, via a gearwheel 22, drives coaxial gearwheels 23, 24 which respectively drive the conveying rollers 14 and 15. The pivot shaft 25 on which the advancer 19 is mounted is also coupled, by means not shown, to drive shaft 21 in order to cause the advancer 19 to pivot in the forward and backward directions.

As noted, in the disclosed embodiment the advancer 19 is fork-shaped, at least in the region of its free end, so that it can engage the rear edges of the outer lateral tabs of the collar defining members 12. The guide member 17 is provided with slots 26 (see FIG. 2) which allow the requisite movement of the free end of advancer 19. The guide member 17 and/or the guide member 18 can additionally be provided with shoulders or webs **27*a* or the like for the lateral guidance of the collar defining members 12. Also, the lower guide member 17 can be extended beyond conveyor 2, on both sides in the conveying direction, and be equipped with a stop for the collar defining members 12. The arrangement of the guide members and the stroke of the advancer 19 results in the collar defining members 12 being centered and positioned, on lateral extensions of guide member 17, above the position which will be occupied by a cell 4 on the lower conveyor 2** at the end of a step of motion of the conveyor.

In the transfer station between conveyors 1 and 2, i.e., in the region into which the collar feed 11 opens, a vertical guide 27 is located opposite to the guide members 17, 18. Vertical guide 27 extends essentially over the height of the cells 3, 4 and the space therebetween. At its upper side, adjacent to a cell 3 on the conveyor 1, the guide 27 is provided with a bevel 28 which serves to retain the wrapped cigarette block 7 in the cell. The short inward extension of guide 27 in the region between the cells 3, 4, as defined by the bevel, is necessary since the guide which supports the wrapped cigarette blocks 7 in the cells 3 as they travel on conveyor 1 will terminate short of the transfer station. Thus, without the shaping of the vertical guide 27, there would be no lower support for the contents 7 of the cells 3.

A slide member 29, which is movable along a vertical guide 30, is located in the region of the transfer station. The up and down movement of slide 29 is produced by a crank mechanism 31, only a part of which is shown. The slide 29 has an approximately U-shaped frame 32 with inwardly directed portions 33 extending parallel to the bottom portion **4*a* of cell 3. Since the cells 3 and 4 have a bottom portion 4*a* which is correspondingly shortened on both sides, the inwardly directed portions 33 of slide 29 can push a wrapped cigarette block 7 out of a cell 3 and into a cell 4. During this transfer of a wrapped cigarette package from an upper cell 3 into a lower cell 4, the partly formed package is guided on one side by the guide member 18 and on the opposite side by the vertical guide 27. The wrapped cigarette block 7 is first compressed slightly during this transfer, in order to travel past the slight inward projection of vertical guide 27 defined by bevel 28, and the block then is released as it moves into the cell 4 since the vertical guide 27 has a setback 34 in the region of the cell 4**.

As the wrapped cigarette block 7 is transferred from a cell 3 to a cell 4, the collar defining member 12 which has been positioned above the cell 4 is forced downwardly along with the wrapped cigarette block and folded, on its folding lines, about the wrapped cigarette block 7. This results in the lateral portions of the collar defining member 12 being pressed in-between the side walls **4*b* of the cell 4 and the cigarette block. Thus, the cell defining member 12 is formed into a generally U-shaped configuration which extends across the bottom and around the two sides of the wrapped block 7**.

It should be noted that the advancer 19 could be replaced by a device which engages the collar defining member 12 as it leaves the nip of rollers 14, 15 and moves it into the desired position. Such an alternative to the mechanical advancer 19 could, for example, comprise a vacuum-type device.

In the practice of the invention, the collar defining member 12 can be delivered into position by feed 11 prior to the arrival of the cell 4 on conveyor 2 which is to be filled. Thus, the positioning of the collar defining members 12 does not lengthen the transfer time of the wrapped inner packs 7 from conveyor 1 to conveyor 2.

If the cigarette package being produced is intended to contain a coupon, a coupon feed, indicated generally at 35, may be provided. The coupon feed 35 comprises a rotating knife 36, driven by gearwheel 22, and a cooperating stationary knife 37. A web of coupons 38 is fed to the knives 36, 37. Individual coupons are severed from the web 38 by knives 36, 37 and the leading edge of a severed coupon is engaged by a pair of conveying rollers 39 and moved into the nip of rollers 14, 15 and onto a collar defining member 12. Accordingly, the coupon, together with the collar defining member 12, is first conveyed by the rollers 14, 15 and subsequently positioned over a cell 4 by the advancer 19. The coupon, accordingly, will be positioned between the wrapped cigarette block 7 and the collar, the outer package defining blank subsequently being adhesively bonded to the collar. The conveying rollers 39 are driven via a gearwheel 40 which engages a gearwheel 41, gearwheel 41 operating the knife 36 and being in engagement with the gearwheel 22.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In apparatus for the packaging of cigarettes, the apparatus incorporating an irregularly shaped collar defining member into each package during the fabrication thereof with said member being of a smaller width then the circumference of a package, the improvement comprising:

first conveyor means, said first conveyor means including a plurality of spacially separated cells, said cells each being sized and shaped to receive and transport a cigarette block wrapped with inner paper, said cells of said first conveyor means having a bottom wall and a pair of longitudinal side walls and being open on the side thereof which is opposite to the bottom wall;

second conveyor means, said second conveyor means including a plurality of spacially separated cells, said cells of said second conveyor means each being sized and shaped to receive and transport a cigarette block, the cells of second conveyor means having a bottom wall and a pair of longitudinal side walls and being open on the side thereof which is opposite to the bottom wall, said second conveyor means being positioned relative to said first conveyor means so as to cause cells of said first and second conveyor means to be brought into an aligned confronting relationship whereby an individual wrapped cigarette block may be transferred from a cell of said first conveyor means to a cell of second conveyor means, said transfer occurring at a transfer station, cells of said first and second conveyor means being spacially displaced at said transfer station;

means for feeding collar defining members into the space between aligned cells of said first and second conveyor means at the transfer station, said feeding means positioning and subsequently supporting a collar defining member above the position to be occupied by the open side of a cell on side second conveyor means means for pushing the contents of a cell of said first conveyor means into an aligned cell of said second conveyor means for pressing the collar defining member into the receiving cell of said second conveyor means by the contents of an aligned cell of said first conveyor means, to fold the collar defining member about only three sides of a wrapped cigarette block during the pushing of the contents of the cell of said first conveyor means into the cell of said second conveyor means said feeding means including:

lever means for advancing the collar defining members into the transfer station, said lever means having arm means which engage a trailing edge of a collar defining member; and guide means for defining the path of motion of the collar defining members while such members are engaged by said arm means;

said feeding means further comprises:

cooperating conveying rollers arranged upstream in the direction of collar defining member movement from said guide means; and drive means for causing said arm means to move in a forward direction through the region of said rollers and said guide means to thereby push an engaged collar defining member into the transfer station, said drive means causing a retraction of said arm means after delivery of a collar defining member into the transfer station.

2. The apparatus of claim 1 wherein a cell of said second conveyor means is positioned beneath a cell of said first conveyor means at the transfer station and wherein said cell open sides define generally parallel and horizontal planes at said transfer station.

3. The apparatus of claim 1 further comprising:

means for applying a retaining force to a wrapped cigarette block in a cell of said first conveyor means in the region of the transfer station to prevent movement of the said wrapped block toward said second conveyor means prior to operation of said pushing means, the force applied by said force applying means being overcome by said pushing means without damage to the wrapped cigarette block.

4. The apparatus of claim 3 wherein said force applying means comprises a shaped stationary plate which defines one side of the transfer station, said plate being disposed oppositely with respect to the said guide means.

5. The apparatus of claim 4 wherein said cells of said conveyor means are provided with cut-outs and wherein said pushing means is caused to move through said cut-outs.

6. The apparatus of claim 1 wherein said pushing means comprises a slide and wherein said apparatus further comprises:

guide means for imparting linear motion to said slide.

7. The apparatus of claim 1 further comprising:

means for inserting coupons in the package being formed, said coupon inserting means comprising a coupon feed which cooperates with said feeding means to position a coupon on a collar defining member before it is moved into the transfer station.

8. The apparatus of claim 7 wherein said coupon feed includes means for severing individual coupons from a web of coupons.

9. The apparatus of claim 1 wherein said conveyor means each comprise a belt-type conveyor, said cells being mounted on the belts of said conveyors.

10. The apparatus of claim 1 wherein the cells of said second conveyor means are positioned beneath the cells of said first conveyor means when in the transfer station and wherein said cell open sides define generally parallel and horizontal planes at the transfer station.

11. The apparatus of claim 2 further comprising:

means for applying a retaining force to a wrapped cigarette block in a cell of said first conveyor means in the region of the transfer station to prevent movement of the said wrapped block toward said second conveyor means prior to operation of said pushing means, the force applied by said force applying means being overcome by said pushing means without damage to the wrapped cigarette block.

12. The apparatus of claim 4 wherein the cells of said second conveyor means are positioned beneath the cells of said first conveyor means when in the transfer station and wherein said cell open sides define generally parallel and horizontal planes at the transfer station.

13. The apparatus of claim 3 wherein said pushing means comprises a slide and wherein said apparatus further comprises:

guide means for imparting linear motion to said slide.

14. The apparatus of claim 13 wherein said feeding means further comprises:

conveying rollers which engage a collar defining member over substantially its entire length measured in the direction of collar defining member movement caused by said lever means.

15. The apparatus of claim 12 wherein said conveyor means each comprise a belt-type conveyor, said cells being mounted on the belts of said conveyors.

16. The apparatus of claim 1 wherein said conveying rollers engage a collar defining member over substantially its entire length in the direction of collar member movement caused by said lever means.

17. The apparatus of claim 2 wherein said lever means is pivotal whereby said arm means is caused to undergo reciprocal arcuate motion.

18. The apparatus of claim 12 wherein said lever means is pivotal whereby said arm means is cause to undergo reciprocal arcuate motion and wherein said arm means includes a pair of elongated arms which engage the trailing edge of a collar defining member in regions located adjacent a pair of oppositely disposed side edges of said collar defining member.

* * * * *

UNITED STATES PATENT AND TRADEMARK OFFICE

CERTIFICATE OF CORRECTION

PATENT NO. : 5,146,728

DATED : September 15, 1992

INVENTOR(S) : Siegfried Knecht and Jurgen Sakowski

It is certified that error appears in the above-identified patent and that said Letters Patent is hereby corrected as shown below:

Column 5, line 57, change "side" (second occurrence) to --said--;

line 58, after "means" (first occurrence) insert --;-- and begin a new paragraph;

line 63, after "means" delete ",".

Signed and Sealed this

First Day of March, 1994

Bruce Lehman

*Attest:*

BRUCE LEHMAN

*Attesting Officer*

*Commissioner of Patents and Trademarks*